US006755612B2

(12) United States Patent
Shahpar et al.

(10) Patent No.: US 6,755,612 B2
(45) Date of Patent: Jun. 29, 2004

(54) GUIDE VANE FOR A GAS TURBINE ENGINE

(75) Inventors: Shahrokh Shahpar, Derby (GB); Mark D Taylor, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/232,725

(22) Filed: Sep. 3, 2002

(65) Prior Publication Data

US 2004/0091353 A1 May 13, 2004

(51) Int. Cl.[7] ..... F01D 9/04
(52) U.S. Cl. ..... 415/192; 415/208.2
(58) Field of Search ..... 415/192, 191, 415/208.2; 416/228

(56) References Cited

U.S. PATENT DOCUMENTS 5,115,642 A * 5/1992 Cvelbar et al. ..... 60/751
6,341,942 B1 * 1/2002 Chou et al. ..... 416/228

* cited by examiner

*Primary Examiner*—Edward K. Look
*Assistant Examiner*—Kimya N McCoy
(74) *Attorney, Agent, or Firm*—Warren Taltavull; Manelli, Dension & Selter PLLC

(57) ABSTRACT

A guide vane is adapted to be mounted in an annular fluid-conveying duct of a gas turbine engine, and has an aerofoil part which extends radially across the duct when the guide vane is thus-mounted. On a transverse cross-section relative to the direction of intended fluid flow across the aerofoil part, at least a portion of the aerofoil part is S-shaped.

13 Claims, 5 Drawing Sheets

GUIDE VANE FOR A GAS TURBINE ENGINE

FIELD OF THE INVENTION

The present invention relates to a guide vane which is adapted to be mounted in an annular fluid conveying duct of a gas turbine engine.

BACKGROUND OF THE INVENTION

A typical gas turbine engine contains several annular fluid-conveying ducts which form e.g. the compressor or turbine sections of the engine.

Each of these ducts contains a number of blades or vanes (which we henceforth call guide vanes) which are circumferantially distributed in one or more guide vane assemblies in the duct. The guide vanes are classed as rotor blades or stator vanes depending on whether or not the respective guide vane assembly rotates in the duct when the engine operates. Each guide vane has an aerofoil part which extends radially across the duct, the aerofoil part having a pressure side and a suction side.

It is usual for the aerofoil part of each guide vane to span radially across the duct in a generally straight line, although a degree of "lean", relative to the straight line extending from the axis of the duct and passing through the radially inward end of the guide vane, is typically introduced to reduce or eliminate corner stalls and suppress or delay secondary-flow formations. GB 712,589 describes an assembly having guide vanes which present C-shaped or cranked profiles (suction side in) when viewed axially along the duct. This type of profile is intended to improve the fluid flow distribution in the annular duct.

SUMMARY OF THE INVENTION

An object of the present invention is further to improve the fluid flow in an annular fluid-conveying duct of a gas turbine engine, and thence improve the efficiency of the engine.

In a first aspect the present invention provides a guide vane which is adapted to be mounted in an annular fluid-conveying duct of a gas turbine engine with an aerofoil part of the guide vane extending radially across the duct, wherein, on a transverse cross-section relative to the direction of intended fluid flow across the aerofoil part, at least a portion of the aerofoil part is S-shaped.

We have found that by adopting such an S-shape the pressure loads on the vane are altered relative to conventional vanes, and the amount of secondary flow can be substantially reduced. By secondary flow we mean fluid movement away from the primary flow direction. Secondary flow is generally undesirable as it tends to promote non-uniform fluid movement towards the exit of the vane and enhances mixing loosen.

We believe the S-shape may encourage a vortex having the opposite sense to the duct vortex, which reduce the amount of secondary flow. In any event, modelling results suggest that the S-shape of the present invention and the C-shape of GB 712,559 generate different vane loadings, particularly at low- to mid-span on the aerofoil part of the vane (low-span being closer to the axis of the duct). Advantageously, compared with the C-shape, the S-shape appears to reduce the mid-span loading and hence to reduce the likelihood of flow separation.

The kinetic energy associated with secondary flow is termed the secondary kinetic energy (SKE). Modelling results suggest that the SKE of a highly-loaded, low aspect ratio turbine nozzle guide vane can be reduced by as much as 60% by adopting an S-shape. This can lead to a 2% improvement in vane efficiency. Similar improvements are expected for guide vanes at other engine locations and with higher aspect ratios.

In preferred embodiments, the S-shape is smoothly curved throughout its length, as abrupt changes in geometry can lead to boundary layer thickening and increases in loss. However, in other less preferred embodiments the S-shape may comprise two or more mutually inclined rectilinear subsections. Thus the S-shape may have two sharp corners (i.e. be "Z-shaped") or have a smooth curve and a sharp corner.

The S-shaped portion effectively produces two major changes of direction (i.e. in geometric terms, a maximum and a minimum) in the aerofoil part. Preferably, the guide vane is shaped so that, when the guide vane is mounted in the duct, the major changes of direction are to respective radial sides of the radially mid span position of the duct. This appears to provide the best reductions in SKE and mid-span loading.

However, the acrofoil part may have more than two major changes of direction. For example, a W- or M-shaped portion (i.e. an S-shaped portion having at one end an additional bend or corner) would have three major changes of direction. Thus the S-shaped portion may be sinusoidal with two, three or more maxima and minima.

Preferably, the guide vane is shaped so that, when the guide vane is mounted in said duct and is viewed from the pressure side of the aerofoil part, the radially inner part of the S-shaped portion appears concave and the radially outer part of the S-shaped portion appears convex.

In one embodiment, the leading edge of the aerofoil part has an S-shaped portion, and/or the transverse cross-section midway between the leading edge and the trailing edge of the vane has an S-shaped portion.

In a preferred embodiment, however, the leading and trailing edges of the aerofoil part and all transverse cross-sections therebetween have S-shaped portions.

In a further aspect, the present invention provides a gas turbine engine, or a component of a gas turbine engine, comprising a plurality of guide vanes according to the previous aspect. The component may be e.g. a blisk (a bladed disk), an assembly of circularly arranged guide vanes, or part of such an assembly.

BRIEF DESCRIPTION OF THE DRAWINGS

The present invention will now be described in relation to a specific embodiment and with reference to the following drawings in which.

DETAILED DESCRIPTION OF THE INVENTION

S. Shahpar, L. Lapworth, T. Depablos and M. Taylor, "A Linear Approach to the Multiparameter Design of Three-Dimensional Turbomachinery Blades, AIAA 99-0363, 37th AIAA Aerospace Sciences Meeting and Exhibit, Reno Nev.; S. Shahpar and D. Radford, "Application of the FAITH Linear Design System to a Compressor Blade", ISABE-99-7045, 14th International Symposium on Airbreathing Engines, Florence, Italy; and S. Shahpar, "Three-dimensional Design and Optimisation of Turbomachinery Blades using the Navier-Stokes Equations", ISABE-2001-1053, 15th International Symposium on Airbreathing Engines, Bangalore, India (all or which are incorporated herein by reference) describe an inverse method, termed FAITH (Forward And Inverse Three-dimensional), which can be used to optimise guide vane geometry for a predetermined flow field. Essentially, FAITH performs extensive 3D RANS (Reynolds Averaged Navier-Stokes) computations to minimise a cost function.

Using FAITH to minimise an SKE cost function for a predetermined flow field across a circumferentially spaced array of guide vanes, the present inventors have found that, on a transverse cross-section relative to the direction of intended fluid flow across the aerofoil part of a guide vane, if at least a portion of the aerofoil part is sinusoidal or S-shaped the secondary flow losses are reduced. More typically for an optimised geometry, substantially all such transverse sections of the aerofoil part should be sinusoidal.

The optimum geometry has an advantage of minimising the secondary flow losses by reducing mixing losses towards the exit-lane of the vane as well as producing a more uniform flow for downstream blade or vane rows.

Figure 1:
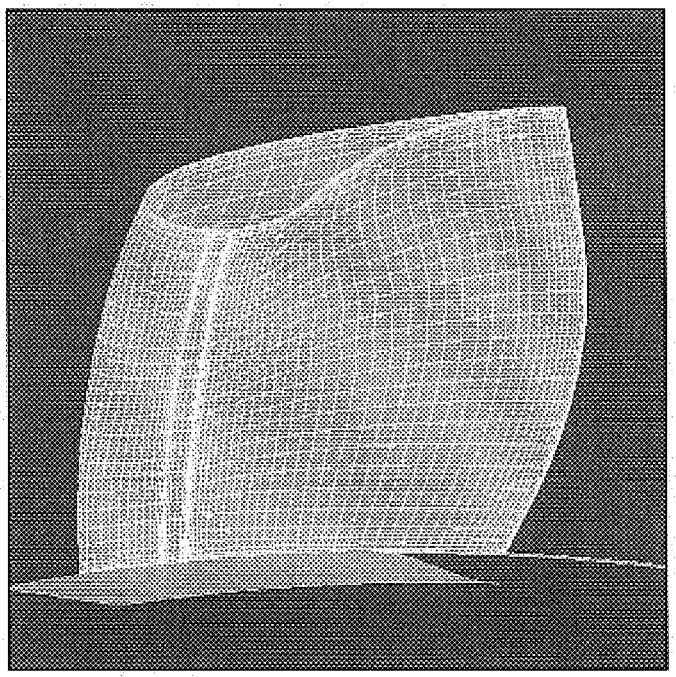
FIG. 1 shows the base geometry of a guide vane prior to optimization.

FIG. 1 shows the base geometry of a guide vane prior to FAITH optimisation. The leading edge of the vane is at the left hand side. The vane is conventional in shape with a slight C-shaped trailing edge.

In this case, for the FAITH optimisation the variable parameters of the base geometry are the respective circumferential positions of the vane at seven parallel sections spaced between the root and tip of the vane. Effectively, during the optimisation seven spaced aerofoil sections are allowed to move in the circumferential direction (relative to the annular duct in which the vane is positioned), with fourth order polynomial smoothing being used to smooth the vane geometry between the sections.

Figure 2:
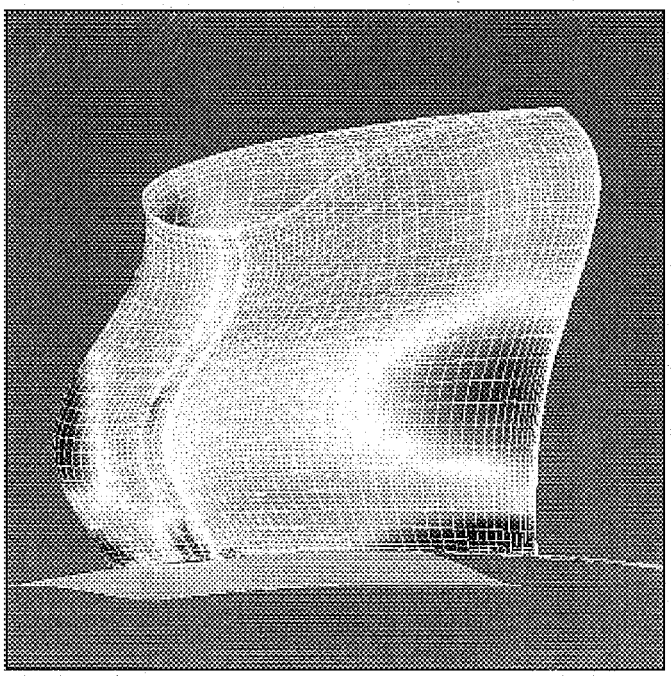
FIG. 2 shows the geometry of the guide vane of FIG. 1 after optimization.

FIG. 2 shows the guide vane geometry after FAITH optimisation. Clearly a pronounced S-shape has been produced in the leading edge by movement of the aerofoil sections in the circumferential direction. The S-shape is thus transverse to the direction of intended fluid flow across the vane. The S-shape is carried through the vane to the trailing edge, although becoming progressively less pronounced.

The vane in FIG. 2 is being viewed from the pressure side and it is to be noticed that the radially inner part of the S-shape appears concave and the radially outer part of the S-shape appears convex.

Figure 3:
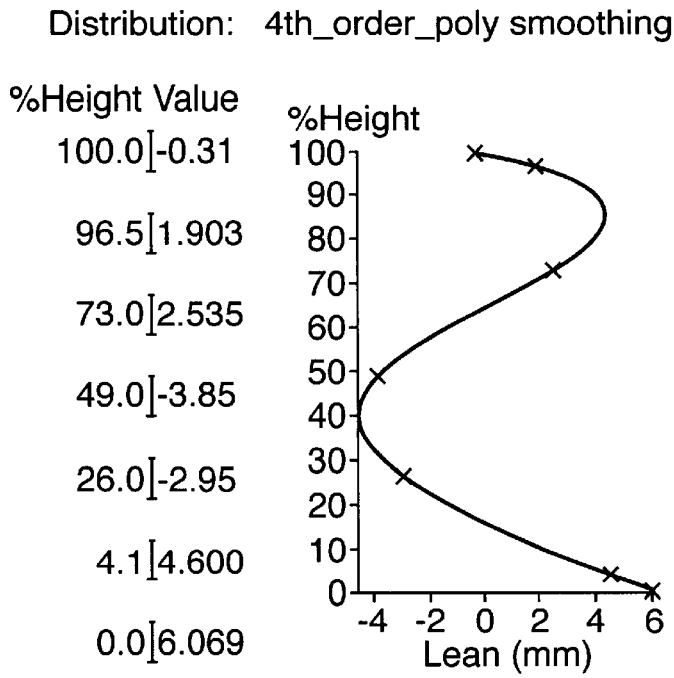
FIG. 3 is a graph showing the amount of lean, relative to the base geometry, of the optimised geometry of FIG. 2 for each of seven parallel sections spaced between the root and tip, 0% height corresponding to the base of the vane and 100% height corresponding to the tip of the vane.

FIG. 3 is a graph showing the amount of circumferential movement (i.e. "lean") of each of the seven spaced sections relative to the base geometry. The S-shape is also clearly visible In this graph. 0% height corresponds to the base of the vane and 100% height corresponds to the tip of the vane.

The optimisation also changes other geometrical descriptors such as the stack angles of successive vane aerofoil reference points. The stack angle of the $k^{th}$ aerofoil reference points is defined as:

$$\tan^{-1}\left[\frac{(r\theta)_{k+1}-(r\theta)_k}{r_{k+1}-r_k}\right]$$

where k increments by one in the radial (span) direction for successive reference points, r is the radius of the respective reference point from the axis of the annular duct (i.e. the axis of the main engine shaft), and θ is the relative angular position of each reference point. The reference points may be points along the leading edge or trailing edge or may be successive aerofoil section centroids.

Figure 4:
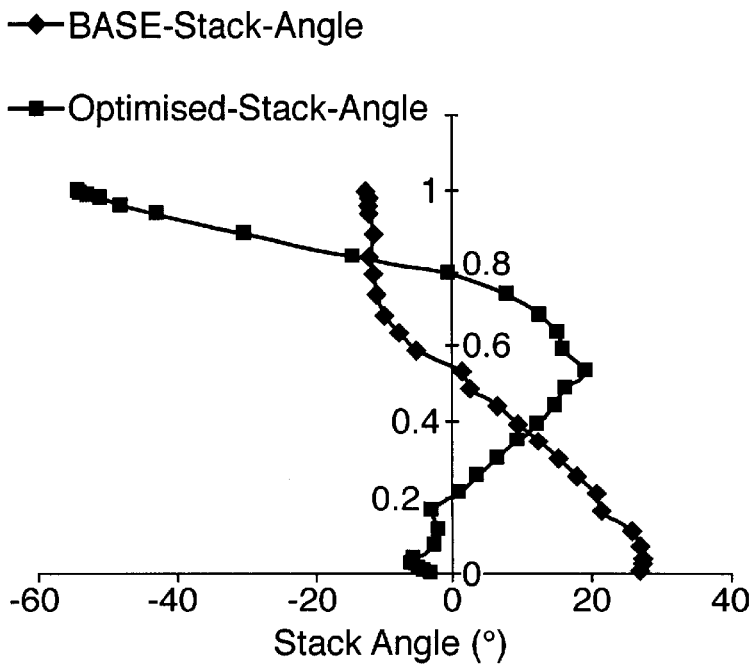
FIG. 4 shows the stack angles along the trailing edges of the base and optimised geometries of FIGS. 1 and 2, a height of 0 corresponding to the base of the vane and a height of 1 corresponding to the tip of the vane.

FIG. 4 shows the stack angles along the trailing edges of the base and optimised geometries of FIGS. 1 and 2. In this case a height of 0 corresponds to the base of the vane and a height of 1 corresponds to the tip of the vane.

Sensitivity studies have also been performed to determine significant features of the optimised geometry.

Figure 5:
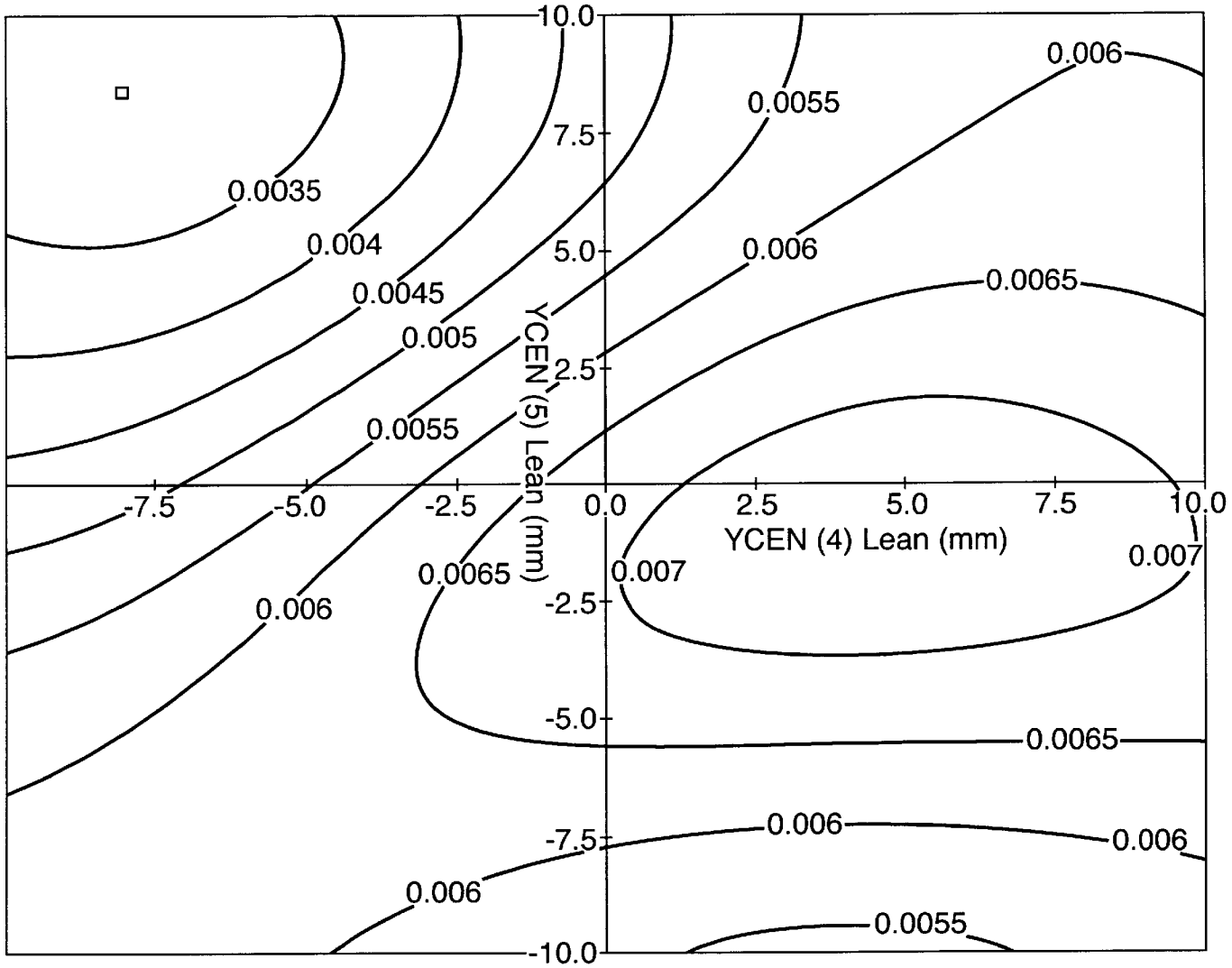
FIG. 5 is a graph showing the result of a sensitivity study on the geometry of FIG. 1, the contours being lines of equal SKE, FIGS. 6*a* and *b* show respectively the pressure and suction sides of the guide vane of FIG. 1 after a further optimization, FIGS. 7*a* and *b* show respectively base and optimised geometries of a further vane, with SKE contours for the trailing edges of the geometries also being shown.

FIG. 5 is a graph showing the result of such a study. However, in this case the base geometry of FIG. 1 was optimised while allowing only the two aerofoil sections at height positions 49.0% (YCEN (4)) and 73.0% (YCEN (5)) to vary. The contours in FIG. 5 are contours of equal SKE for different lean values of YCEN (4) (x-axis) and YCEN(5) (y-axis). The minimum SKE is at the top left hand corner of the graph which indicates that the lean at opposite sides of the mid-span position (50%) should be in opposite directions to most effectively reduce the SKE. This implies that the maximum and minimum of the S-shape should preferably be located to respective sides of the mid-span position.

Figure 6A:
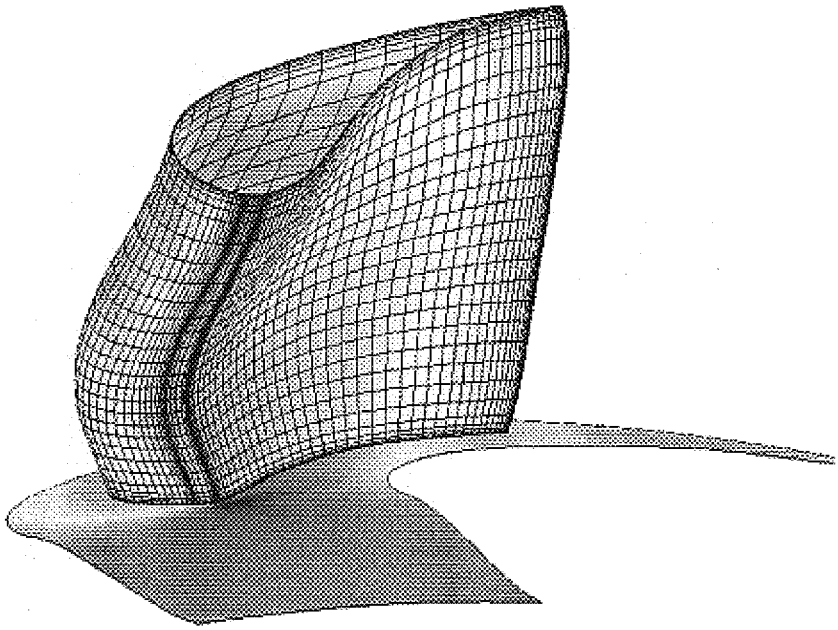

FIG. 6*a* shows the result of a further FAITH optimisation on the base geometry of FIG. 1 (the leading edge of the vane being at the left hand side and the vane being viewed from the pressure side). However, in this case each of the seven spaced sections was allowed to move in the axial direction of the duct as well as the circumferential direction, thereby producing "sweep" as well as "lean". The result of optimising using lean and sweep is that the vane adopts an S-shape along the leading edge, the S-shape being transverse to the direction of intended fluid flow across the vane.

Figure 6B:
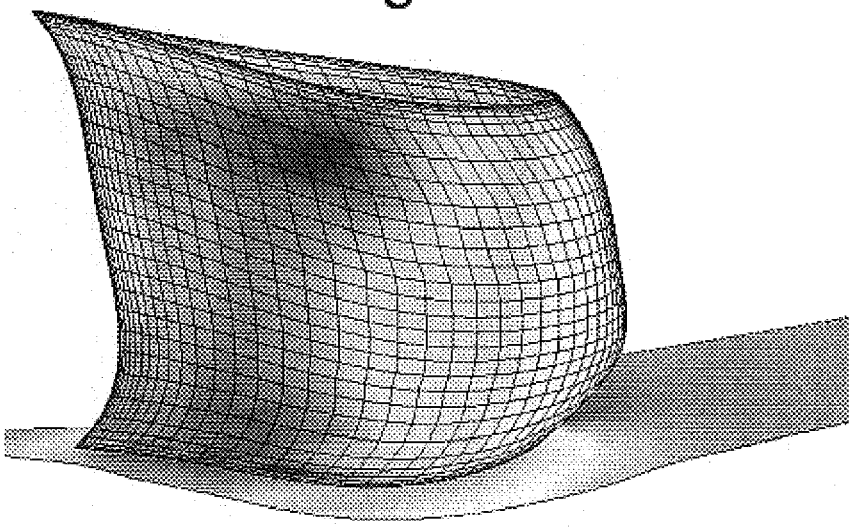

FIG. 6*b* shows the same blade but viewed from the suction side (trailing edge at the left hand side). From this angle the pronounced sweep produced by the optimisation at the end walls of the blade is apparent.

Figure 7A:
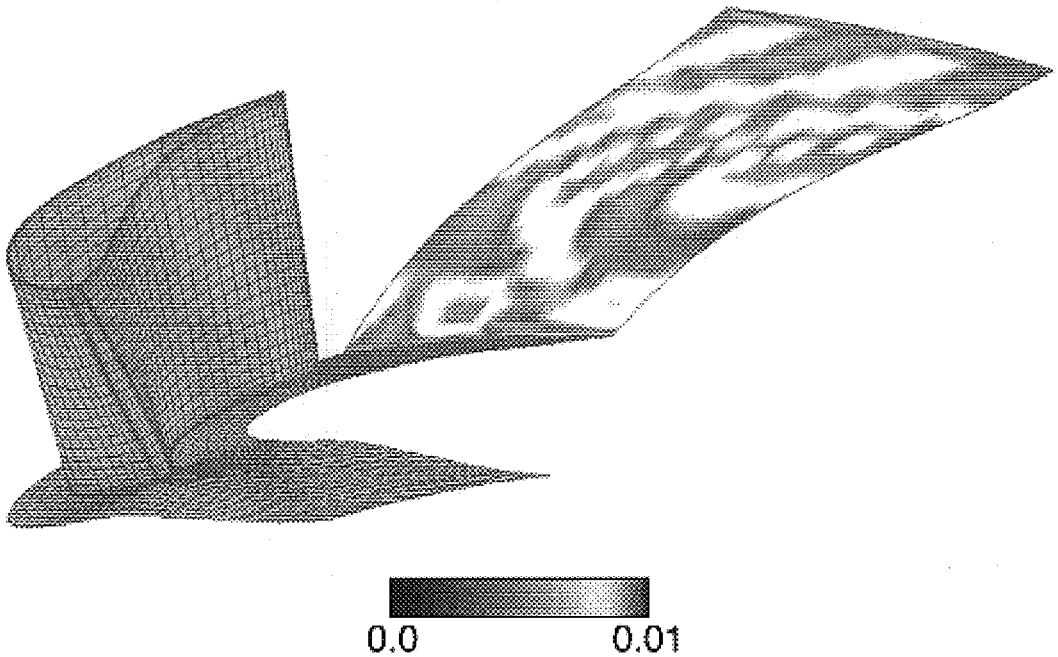
Figure 7B:
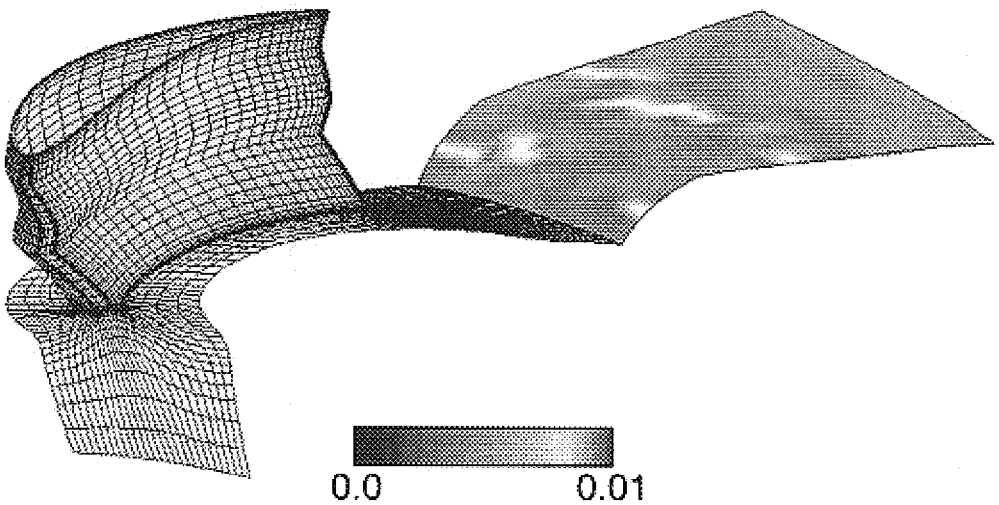

FIGS. 7*a* and *b* show respectively base and optimised geometries of a further vane. In this case, however, the figures also show contours of SKE at the trailing edges of the geometries. Clearly the secondary flow losses are much reduced and more uniformly distributed with the optimised geometry. The optimization used the same procedure that was applied to obtain the geometry of FIGS. 6*a* and *b,* i.e. variation of lean and sweep.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

We claim:

1. A guide vane which is adapted to be mounted in an annular fluid-conveying duct of a gas turbine engine, the guide vane having an aerofoil part which, when the guide vane is thus-mounted, extends radially across the duct, wherein, on a transverse cross-section relative to the direction of intended fluid flow across the aerofoil part, a substantial portion of the aerofoil part is S-shaped and wherein the guide vane is shaped so that, when the guide vane is mounted in said duct and is viewed from the pressure side of the aerofoil part, the radially inner part of the S-shaped portion appears concave and the radially outer part of the S-shaped portion appears convex.

2. A guide vane according to claim 1, wherein said S-shaped portion is smoothly curved throughout its length.

3. A gas turbine engine as claimed in claim 1, wherein the at least a portion of the aerofoil part is W-shaped.

4. A gas turbine engine as claimed in claim 1 wherein the leading edge is swept.

5. A guide vane which is adapted to be mounted in an annular fluid-conveying duct of a gas turbine engine, the guide vane having an aerofoil part which, when the guide vane is thus-mounted, extends radially across the duct, wherein, on a transverse cross-section relative to the direction of intended fluid flow across the aerofoil part, a substantial portion of the aerofoil part is S-shaped wherein the guide vane is shaped so that, when the guide vane is mounted in the duct, the major changes of direction of the S-shaped portion are to respective radial sides of the radially mid-span position of the duct.

6. A gas turbine engine as claimed in claim 5, wherein the major changes in the direction are at about 40% and at about 85% of the radial span of the guide vane from the root to the tip of the guide vane.

7. A guide vane which is adapted to be mounted in an annular fluid-conveying duct of a gas turbine engine, the guide vane having an aerofoil part which, when the guide vane is thus-mounted, extends radially across the duct, wherein, on a transverse cross-section relative to the direction of intended fluid flow across the aerofoil part, a substantial portion of the aerofoil part is S-shaped wherein the transverse cross-section is midway between the leading edge and the trailing edge of the vane.

8. A guide vane which is adapted to be mounted in an annular fluid-conveying duct of a gas turbine engine, the guide vane having an aerofoil part which, when the guide vane is thus-mounted, extends radially across the duct, wherein, on a transverse cross-section relative to the direction of intended fluid flow across the aerofoil part, a substantial portion of the aerofoil part is S-shaped wherein the leading edge of the aerofoil part has an S-shaped portion.

9. A guide vane which is adapted to be mounted in an annular fluid-conveying duct of a gas turbine engine, the guide vane having an aerofoil part which, when the guide vane is thus-mounted, extends radially across the duct, wherein, on a transverse cross-section relative to the direction of intended fluid flow across the aerofoil part, a substantial portion of the aerofoil part is S-shaped wherein the leading and trailing edges of the aerofoil part and all transverse cross-sections therebetween have S-shaped portions.

10. A component of a gas turbine engine, comprising a plurality of guide vanes according to any one of the previous claims.

11. A gas turbine engine component as claimed in claim 10 wherein the component comprises a bladed disk.

12. A gas turbine engine component as claimed in claim 10 wherein the component comprises an assembly of circularly arranged guide vanes.

13. A gas turbine engine as claimed in claim 9 wherein the S-shape becomes progressively less pronounced from the leading edge to the trailing edge.

* * * * *